United States Patent [19]

Gadefelt et al.

[11] Patent Number: 4,484,550

[45] Date of Patent: Nov. 27, 1984

[54] INTERNAL COMBUSTION ENGINE WITH AT LEAST ONE COMBUSTION CHAMBER HAVING FOUR VALVES

[75] Inventors: Bengt G. Gadefelt; Lars L. Sääf, both of Södertälje, Sweden

[73] Assignee: Saab-Scania Aktiebolag, Sweden

[21] Appl. No.: 355,752

[22] PCT Filed: Jun. 30, 1981

[86] PCT No.: PCT/SE81/00196

§ 371 Date: Feb. 25, 1982

§ 102(e) Date: Feb. 25, 1982

[87] PCT Pub. No.: WO82/00318

PCT Pub. Date: Feb. 4, 1982

[30] Foreign Application Priority Data

Jul. 10, 1980 [SE] Sweden ..... 8005072

[51] Int. Cl.[3] ..... F02B 23/04

[52] U.S. Cl. ..... 123/308; 123/193 H; 123/315; 123/666

[58] Field of Search ..... 123/315, 308, 432, 662, 123/193 H, 664, 657, 188 S, 193 C, 193 CH, 661, 666

[56] References Cited

U.S. PATENT DOCUMENTS

| | | | |
|---|---|---|---|
| 3,094,977 | 6/1963 | Sampietro | 123/666 |
| 3,424,143 | 1/1969 | Apfelbeck | 123/666 |
| 3,633,577 | 1/1972 | Piatti | 123/662 |
| 4,106,444 | 8/1978 | Deutschmann et al. | 123/193 H |
| 4,363,300 | 12/1982 | Honda | 123/432 |

FOREIGN PATENT DOCUMENTS

| | | | |
|---|---|---|---|
| 0542938 | 7/1957 | Canada | 123/315 |
| 0488736 | 6/1954 | Italy | 123/315 |
| 598343 | 9/1959 | Italy | 123/666 |
| 2359058 | 8/1974 | Fed. Rep. of Germany | 123/193 H |
| 0044404 | 4/1981 | Japan | 123/315 |
| 0467320 | 6/1937 | United Kingdom | 123/315 |
| 1152632 | 5/1969 | United Kingdom | 123/666 |
| 1212692 | 11/1970 | United Kingdom | 123/315 |
| 1256401 | 12/1971 | United Kingdom | 123/432 |

*Primary Examiner*—Ira S. Lazarus
*Assistant Examiner*—R. S. Bailey
*Attorney, Agent, or Firm*—Ostrolenk, Faber, Gerb & Soffen

[57] ABSTRACT

Internal combustion engine with at least one combustion chamber produced within a cylinder head or similar device, it being possible to feed a fuel-and-air mixture into said combustion chamber through two inlet valves arranged in the cylinder head and to discharge from the said combustion chamber exhaust gases through two exhaust valves arranged in the cylinder head, with the invention also relating to a method of producing such a combustion chamber by means of a casting process. The invention is characterized in that the combustion chamber (1) consists of four cavities (4,5,6,7) distributed in quadrants with a circular plane forming part of base plane (8) of cylinder head (2), in that each individual cavity (4–7) has a shape which is in the main rotationally symmetrical and in that the cavities (4–7) overlap one another, whereby arc-shaped transitions are formed between cavities (4–7) in base plane (8).

7 Claims, 4 Drawing Figures

Figure 1:
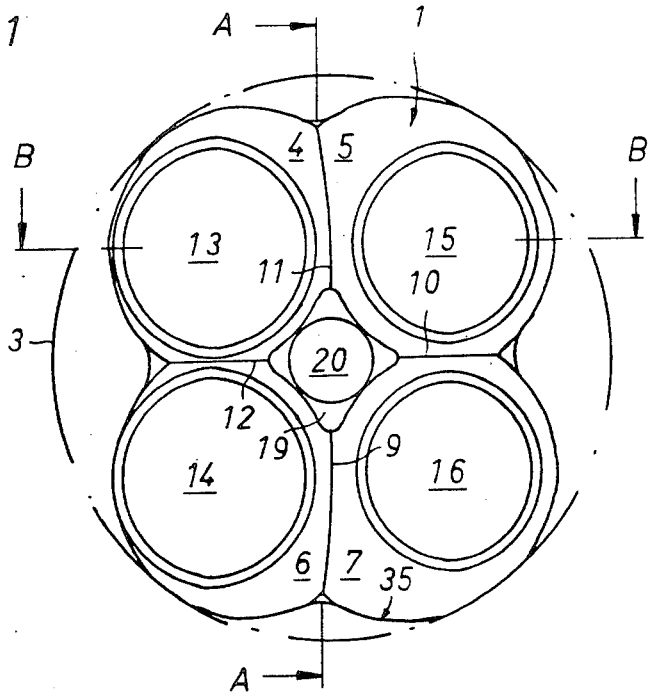

INTERNAL COMBUSTION ENGINE WITH AT LEAST ONE COMBUSTION CHAMBER HAVING FOUR VALVES

The present invention relates to an internal combustion engine with at least one combustion chamber produced in a cylinder head. It is possible to pass a fuel-and-air mixture to the said combustion chamber via two inlet valves arranged in the cylinder head and for the exhaust gases to be discharged from the combustion chamber through two exhaust valves arranged in the cylinder head, whereby the invention also provides for a method of constructing such a combustion chamber so as to enable simple production of internal combustion engines in accordance with the invention.

In the technology of internal combustion engines there is increasing emphasis on the requirement of improving and rationalizing the combustion process in a internal combustion engine. A method of bringing this about consists in improving the volumetric efficiency of the engine, which may be regarded as a measure of how well the combustion chamber can be filled with a fuel-air mixture.

Another method consists in improving the thermal efficiency of the engine, which is a measure of how mell the fuel supplied to it is utilized. The thermal efficiency increases with the compression ratio of the engine and also increases as the fuel supplied is distributed more uniformly within the combustion chamber, enabling even combustion.

The volumetric efficiency can be improved by improving the gas exchange in the combustion chamber, which can be brought about by providing the engine with larger and/or more valves than the two valves per cylinder normally provided in conventional internal combustion engines. To this end it is known how to design engines with four valves per cylinder, with two valves operating as inlet valves and two valves as exhaust valves. By providing four valves the principal aim consists in obtaining a much power as possible from the engine, and such engines have therefore been used mainly in racing cars and other applications, where the engines are made to operate at high speeds.

With four-valve-engines it is known how to design the cylinder head of a cylinder in accordance with a so-called "pent roof"-design. This signifies that the valves and the valve seats are arranged in pairs in two planes that are inclined in relation to one another, with the planes forming a longitudinal crestlike ridge. Such a design is efficient when operating at high engine speeds, since the gases enter the engines at a high velocity thus enabling efficient mixing of the fuel with the incoming air and also distributing the fuel-air mixture in the combustion chamber in a fairly uniform manner. At lower operational speeds the velocity of the incoming gases is reduced, thus causing a poorer distribution of the fuel-air mixture in the combustion chamber. This in turn means that more fuel must be supplied than is theoretically necessary in order to maintain within the combustion chamber a mixture ratio which will not give rise to uncontrolled combustion events, i.e. knocking. As a result the thermal efficiency of such an engine is poor at low and medium operating speeds.

The said "pent roof"-design also necessitates a complicated and hence expensive method of production, and this is that reason why the design has not been utilized to any major extent in connection with the series production of vehicle engines.

With a view to reducing the costs entailed in the production of four-valve-engines it is known from U.S. Pat. No. 3,633,577 how to design a combustion chamber in a cylinder head with two oblong cavities. Such a design enables the combustion chamber to be produced by milling, subject to the condition that during this process the cross-section constitutes the section of the respective cavities of the combustion chamber in one direction. In the other oblong direction the milling cutter forms the respective ends of the two cavities so that they correspond with the arc-shape of the cutter. The design requires the volume of the space in the cylinder head to be relatively large so as to be capable of accommodating sufficiently large valves. This entails difficulties in providing high compression unless other measures are taken to reduce the volume of the combustion chamber, e.g. by designing a matching engine piston with projections, etc. With this design the technical efficiency also of this type of engine is less satisfactory unless the piston is provided with complicated and costly design features.

The present invention is intended to provide a four-valve-engine with a combustion chamber which, owing to increased gas circulation in the combustion chamber of the engine ensures increased efficiency within the entire speed range of the engine and, in addition, enables simple and cheap production of such a combustion chamber in the engine cylinder head. With an internal combustion engine designed in accordance with the invention a fuel-air mixture is introduced through two inlet valves arranged in the cylinder head, and the exhaust gases are discharged through two exhaust valves arranged in the cylinder head. In addition the combustion chamber comprises an ignition device detachabily secured within the cylinder head for igniting the fuel-air mixture supplied while the engine is running. The invention is characterized mainly in that the combustion chamber consists of four cavities distributed in quadrants of a circular plane constituting part of the base plane of the cylinder head, in that each individual cavity has a shape which is generally rotationally symmetrical and in that the cavities overlap one another, with arc-shaped transitions being formed in the base plane between the cavities.

Within a given cylinder diameter the design in accordance with the invention provides a larger squish area than the known designs, and during the compression stroke of the engine this causes the fuel-and-air mixture to be subjected to intense turbulence. As a result the fuel is distributed evenly within the combustion chamber and is burnt more completely and efficiently after ignition than if such turbulence did not occur.

The volume of the combustion chamber in the cylinder head is, in addition, relatively small, and it is therefore simple to dimension the engine with a view to produce a high compression ratio, thus enabling a high thermal efficiency.

Since the gas exchange in the combustion chamber takes place via four valves, also the volumetric efficiency of the engine is relatively high. Combustion in a combustion chamber designed in accordance with the invention thus takes place under favorable conditions, and this enables the fuel supplied to be utilised efficiently, so that less fuel is required.

The invention is also characterised by a method of designing the combustion chamber so as to produce, by means of a casting process, a cylinder head for such an engine, whereby the invention is characterized in that the combustion chamber is provided with four cavities distributed in quadrants of a circular plane which constitutes part of the base plane of the cylinder head, in that each cavity is given a shape which is in the main rotationally symmetrical and in that the cavities are made to overlap one another so that arc-shaped transitions are formed in the base plane between the cavities.

Figure 2:
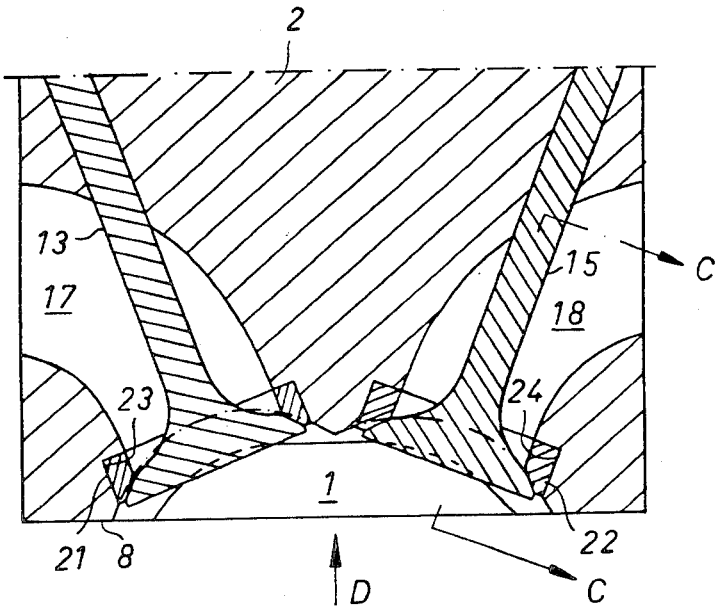
Figure 3:
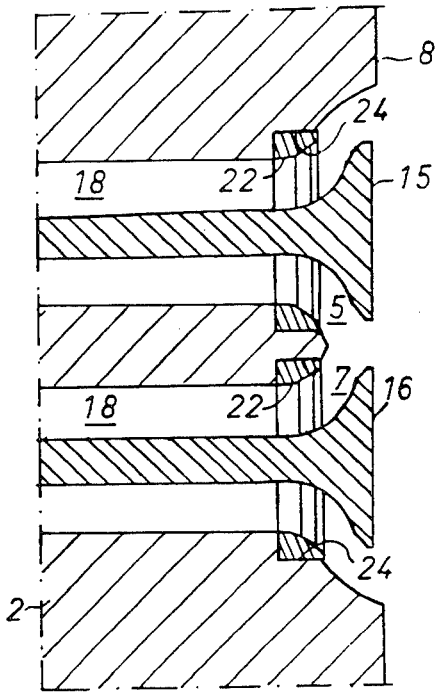
Figure 4:
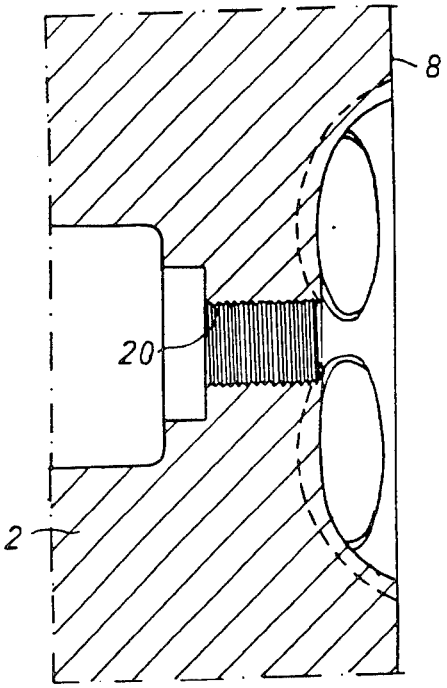

Further features characterizing the invention will be found in the appended patent claims and in the subsequent description of an advantageous embodiment illustrating the invention. The description is given with reference to the attached drawing in which:

FIG. 1 shows a view from below of a combustion chamber in a cylinder head, this view corresponding to view D in FIG. 2, FIG. 2 shows the combustion chamber along section B—B in FIG. 1, FIG. 3 shows the combustion chamber along section C—C in FIG. 2, and FIG. 4 shows a section A—A in accordance with FIG. 1.

The drawings show a combustion chamber 1 in a cylinder head 2 of an internal combustion engine comprising a number of cylinders (not shown) and a corresponding number of pistons (not shown) displaceably located within the cylinders. The circumference of the cylinder comprising combustion chamber 1 is indicated in FIG. 1 by a dash-dotted circle 3. The combustion chamber 1 contains, in accordance with the invention,, four cavities 4, 5,6,7 located in respectine different quadrants, each having an at least in part rotationally symmetrical shape in respect of an axis of symmetry, e.g. a spherodial or ellipsoidal shape. The axes of symmetry of two adjacent cavities 4,6 or 5,7, respectively, are in one direction pairwise parallel. In a direction at right angles to the latter the axes of symmetry of cavities 4,6 or 5,7, respectively, form pairwise two planes intersecting one another below the cylinder head 2 along a line parallel to the crankshaft (not shown) of the engine. The inclinations of the two planes are preferably selected in such a way as to ensure that their inclinations in respect to base plane 8 of cylinder head 2 are equal.

The cavities 4–7 bounded by circle 3 are closer to one another than would correspond to the distance equal to the radii of two cavities 4–7, at least at base plane 8 of cylinder head 2. As a result two adjacent cavities 4–7 overlap one another at least in part and the cavities 4–7 are at least partly communicating with one another within the cylinder head 2, in spite of the fact that they are separated by ridges 9,10,11,12.

Each of the two cavities 4,6 is fitted with an inlet valve 13,14, and each of the two cavities 5,7 is fitted with an exhaust valve 15,16. The valves 13–16 are so-called poppet valves, which can be controlled in known fashion so as to regulate the gas exchange in combustion chamber 1. With a view thereto the valves 13–16 are located in cylinder head 1 in such a manner as to be axially displaceable and they are, in known manner, so arranged as to resiliently abut ring-shaped valve seats 21, 22 pressed into appropriate recesses 23,24 in cylinder head 2. The axial movements of valves 13–16 can be controlled in a known manner by means of the engine camshaft (not shown).

The inlet valves 13,14 regulate the connections of combustion chamber 1 with inlet ducts 17 in cylinder head 2, and the exhaust valves 15,16 regulate the connections between combustion chamber 1 and exhaust ducts 18 in cylinder head 2. The inlet valves 13,14 have a larger diameter than the outlet valves 15,16 and, as a result thereof, the cavities 4,6 containing the inlet valves 13,14 are somewhat larger than the cavities 5,7 contaning the exhaust valves 15,16.

The line of symmetry of valves 13–16 and their valve seats 21,22 preferably coincide with the line of symmetry of that cavity 4–7 containing it.

At the center of combustion chamber 1 ridges 9–12 between cavities 4–7 merge together into a planar surface 19 parallel to base plane 8 of cylinder head 2. The surface 19 contains a threaded hole 20 passing through cylinder head 2. The hole is intended for holding an ignition device (not shown) which when the engine is running ignites a fuel-air mixture that is fed into combustion chamber 1 and compressed.

A combustion chamber 1 in accordance with the invention can be produced by casting the cylinder head 2, but within the scope of the inventive idea combustion chamber 1 can also be produced by milling, wherein each cavity 4–7 is machined in a separate operation, one operation for each quadrant within circle 3. The milling tool (not shown) advantageously consists of a special milling cutter with a spherical section for machining a rotationally symmetrical cavity 4–7 in base plane 8 of cylinder head 2, while a leading cylindrically shaped part of the tool serves to machine a recess 23,24 for valve seats 21,22 in the respective ducts 17,18.

The cavities 4,6 containing the inlet valves 13,14 are in the same way as the corresponding valve seat recess 23 somewhat larger than the corresponding cavities 5,7 and recess 24 for exhaust ducts 18. This is due to the fact that the inlet valves 13,14 are somewhat larger than the exhaust valves 15,16. As a result different milling tools must be used to produce appropriate inlet cavities 4,6 and exhaust cavities 5,7. The appearance and method of operation of cutting tools are however identical, apart from the fact that their dimensions differ.

When forming a combustion chamber by milling, it is usual to surface both the base plane 8 of the cylinder head and the planar 19 for the ignition surface device (not shown) in a final operation. In conjunction therewith also the ridges 9–12 separating the cavities 4–7 can be machined, at least in the proximity of the ignition device hole 20. If the ridges 9–12 are to be machined entirely or in part, use may be made of an appropriate milling tool.

Bearing in mind the production costs it is however more advantageous from the point of view of series production to finish the combustion chamber in accordance with the invention already when casting the cylinder head 2. A combustion chamber designed in accordance with the above description is characterized smooth arcuate boundary lines 35, which considerably facilitates a casting process. Such a process does not exclude the possibility of using other production methods and other means than stated above in order to produce such a combustion chamber 1.

In relation to the cylinder diameter a combustion chamber 1 in accordance with the invention takes up little space. At the same time it is sufficiently large to be capable of accommodating adequately dimensioned valves 13–16. The cylinder head 2 and the engine can therefore be designed to be very compact. Furthermore it is possible to dimension, in a simple way, the engine with a high compression ratio even if use is made of an entirely flat piston head.

When during the compression stroke of the engine the piston approaches its uppermost position, the piston acts with great force on the fuel-air mixture between the piston head and the base plane 8 of cylinder head 2 and presses it inward toward the center of combustion chamber 1. This causes intense turbulence, which is advantageous for efficient mixing of the fuel and is accordingly also advantageous for the combustion. Since the so-called squish area is large, the said area consisting of a cylinder cross-section reduced by the cross-sectional area of the cavities 4–7 at base plane 8 of cylinder head 2, more powerful turbulence is achieved with the design in accordance with the invention than has hitherto been possible. As a result the engine has a high thermal efficiency in that the fuel supplied is utilized to a great extent. At the same time a high volumetric efficiency is achieved, inasmuch as the gas exchange through the four valves 13–16 is rendered more effective.

Within the limits of the subsequent patent claims an internal combustion engine designed in accordance with the invention may be modified so as to achieve alternative embodiments.

We claim:

1. A cylinder head for an internal combustion engine, the cylinder head having at least one combustion chamber; each combustion chamber having two inlet openings in it for inlet valves and having two exhaust openings in it for exhaust valves; each combustion chamber being defined by four cavities formed in the cylinder head each cavity having in it a respective one of the inlet and exhaust openings for defining two inlet cavities and two exhaust cavities; each of the cavities bordering two of the other cavities; the cavities being distributed, as seen in a base plane of said cylinder head, with one cavity in each of four quadrants of a circle corresponding to a cylinder cooperating with said combustion chamber; each of the cavities being generally rotationally symmetrical around a respective axis of symmetry intersecting the base plane; bordering ones of the four cavities communicating with each other at intersections between the bordering cavities, and ridges being formed at the intersections between the bordering cavities, whereby planar squish surfaces are defined in said base plane of said cylinder head within said circle for causing turbulence of a fuel-air mixture.

2. The cylinder head of claim 1, further comprising a hole opening in the combustion chamber for receiving an ignition device for igniting the air-fuel mixture in the combustion chamber.

3. The cylinder head of claim 2, wherein the cylinder head in the combustion chamber has a central section which is planar and is parallel to the base plane of the cylinder head, the hole being through the central section.

4. The cylinder head of claim 1, wherein the respective axes of symmetry of the inlet cavities are parallel to each other and the respective axes of symmetry of the exhaust cavities are also parallel to each other.

5. The cylinder head of claim 4, wherein the axes of the inlet cavities are oriented generally non-parallel to the axes of the exhaust cavities.

6. The cylinder head of claim 1 wherein the combustion chamber has a limiting, peripheral contour, which is defined by interconnected arcuate boundary lines.

7. The cylinder head of claim 1, wherein each of the cavities for containing inlet valves is larger than each of the cavities for containing exhaust valves.

* * * * *